United States Patent [19]

Seimers

[11] Patent Number: 4,805,833

[45] Date of Patent: Feb. 21, 1989

[54] METHOD OF FORMING COMPACTS WITH INTEGRAL CONSOLIDATION CONTAINERS

[75] Inventor: Paul A. Seimers, Clifton Park, N.Y.

[73] Assignee: General Electric Company, Schenectady, N.Y.

[21] Appl. No.: 18,552

[22] Filed: Feb. 25, 1987

[51] Int. Cl.[4] ..... B23K 20/14

[52] U.S. Cl. ..... 228/190; 228/243; 228/193; 29/419.1; 427/37

[58] Field of Search ..... 228/193, 190, 185, 243; 29/419 R, 527.5; 427/34; 419/49

[56] References Cited

U.S. PATENT DOCUMENTS

| | | | |
|---|---|---|---|
| 3,427,185 | 2/1969 | Cheatham et al. | 29/419 |
| 3,748,721 | 7/1973 | Alexander | 228/185 |
| 4,370,789 | 2/1983 | Schilke et al. | 427/34 X |
| 4,411,940 | 10/1983 | Derkacs | 427/34 X |
| 4,574,451 | 3/1986 | Smashey et al. | 29/527.5 |
| 4,577,431 | 3/1986 | Siemers et al. | 427/34 X |

FOREIGN PATENT DOCUMENTS

| | | | |
|---|---|---|---|
| 2027060 | 2/1980 | United Kingdom | 419/49 |

*Primary Examiner*—Kenneth J. Ramsey

*Attorney, Agent, or Firm*—Paul E. Rochford; James C. Davis, Jr.; James Magee, Jr.

[57] ABSTRACT

A method for forming fiber reinforced titanium alloy composite is taught. The composite is formed with an inner and outer high density skin of titanium base alloy prepared by RF plasma spray depositing larger size particles of the alloy. The first skin is formed on a substrate, the fiber reinforcement is applied over the inner portion of the first skin and then a second skin is RF plasma deposited over the reinforcement and outer or edge portions of the first skin to seal the contents of the composite. The composite is then hot isostatic pressed to densify its contents without being enclosed in any auxilliary container such as the conventional HIPing container.

10 Claims, 5 Drawing Sheets

RF SPRAYED Ti-6AL-4V

METHOD OF FORMING COMPACTS WITH INTEGRAL CONSOLIDATION CONTAINERS

RELATED APPLICATIONS

The subject matter of the subject application relates generally to that of copending application Ser. No. 010,655, filed Feb. 4, 1987 and Ser. No. 010,882, filed Feb. 4, 1987 and Ser. No. 018,554, filed Feb. 25, 1987, The texts of the copending applications, including that of related applications of the copending applications are incorporated herein by reference.

BACKGROUND OF THE INVENTION

The present invention relates to the fabrication of high density compacts of various titanium base alloys with high strength at high temperatures. Such compacts may include articles of various shapes and sizes prepared by plasma spray deposition. Following deposition, the compacts are consolidated to high density to achieve the properties of wrought articles.

It is known that silicon carbide filaments can be formed with great strength and with high temperature tolerance. It is also known that titanium metal foils have been used in connection with SiC filaments to produce SiC reinforced composites in which the SiC filaments are embedded in a sheet of titanium alloy made up of a number of layers of foil. Such SiC reinforced titanium alloy composites have been identified as potential high strength materials, that is materials which have high strength to weight ratio. Such materials are deemed to be attractive for use in future aircraft engines having high thrust to weight ratios and in wing structures of transatmospheric vehicles. It is anticipated that such titanium alloy matrix composites and laminates will find application in wound rotors and in casings and is other intermediate temperature high stress applications.

Under present practice, titanium alloy composites have been fabricated by rolling the desired titanium alloy ingot to about 0.008 to 0.010 inch thick sheet. The sheet is employed as alternate layers in a lay up of titanium alloy sheet and an array of parallel SiC fibers held together with very fine Ti ribbon to form a preconsolidated assembly. The assembly is then consolidated by hot pressing or hot isostatic pressing (HIPing).

Fabrication of such thin titanium alloy sheets for formation of such a composite can be very costly. This is particularly so if the titanium alloy is not ductile at room temperature. One alloy which lacks such room temperature ductility is niobium modified $Ti_3Al$. This alloy can only be rolled to foils of about 0.020 inch thick. To obtain thinner sheet requires that the thicker sheet be electrochemically machined to the desired thickness. If the final desired thickness is 0.010 inch, then about half of the original material is lost.

Novel and unique structures are formed pursuant to the present invention by plasma spray deposit of titanium base alloys including titanium-aluminum intermetallic compounds employing RF plasma spray apparatus either with or without reinforcing filaments.

The formation of plasma spray deposits of titanium and of alloys and intermetallic compounds of titanium present a set of processing problems which are unlike those of most other high temperature high strength materials such as the conventional superalloys. A superalloy such as a nickel base or iron base superalloy can be subdivided to relatively small size particles of −400 mesh (about 37 μm) or smaller without causing the powder to accumulate a significant surface deposit of oxygen. A nickel base superalloy in powder form having particle size of less than −400 mesh will typically have from about 200 to about 400 parts per million of oxygen. A powdered titanium alloy by contrast will typically have a ten fold higher concentration of oxygen. A powdered titanium alloy of −400 mesh will have between about 2000 and 4000 ppm of oxygen.

Moreover, titanium alloy powder of less than −400 mesh size is recognized as being potentially pyrophoric and as requiring special handling to avoid pyrophoric behavior.

It is also recognized that the room temperature ductility of titanium alloys decreases as the concentration of oxygen and of nitrogen which they contain increases. It is accordingly important to keep the oxygen and nitrogen content of titanium base alloys at a minimum. This can be very difficult for very finely divided powders of titanium base alloys.

Prior art plasma spray technology is based primarily on use of direct current plasma apparatus. It has been recognized that most as-sprayed plasma spray deposits of the superalloys such as nickel and iron base superalloys have had relatively low ductility and that such deposits when in their as-deposited sheet form can be cracked when bent through a sufficiently acute angle due to the low ductility.

I have discovered that RF plasma apparatus is capable of spraying powder of much larger particle size than the conventional DC plasma apparatus. I have discovered that particle sizes at least three times larger in diameter than those conventionally employed in DC plasma spray apparatus may be successfully employed. The particle size may be as high as 100 μm to 250 μm and larger and as large as 10X as large as the −400 mesh powder previously employed in DC plasma spray practice.

This possibility of employing the larger powder particles is quite important for metal powders such as titanium which are subject to reaction and absorption of gases such as nitrogen and oxygen on their surfaces. One reason is that the surface area of particles relative to their mass decreases inversely as their diameters. Accordingly, a three fold increase in particle diameter translates into a three fold decrease in particle surface area to volume. I have discovered that one result is that RF plasma spray deposited structures of titanium base alloys made with the aid of larger particles have lower oxygen content than might be expected based on knowledge of prior art practices.

As used herein, the term titanium base alloy means an alloy composition in which titanium is at least half of the composition in parts by weight when the various alloy constituents are specified, in parts by weight, as for example in percentage by weight.

A titanium-aluminum intermetallic compound is a titanium-base alloy in which titanium and aluminum are present in a simple numerical atomic ratio and the titanium and aluminum are distributed in the composition in a crystal form which corresponds approximately to the simple numerical ratio such as 3:1 for $Ti_3Al$; 1:1 for TiAl and 1:3 for $TiAl_3$.

$Ti_3Al$ compositions have use temperatures of up to about 1400° F as compared to the use temperatures of titanium alloys such as Ti-6Al-4V of up to about 1000° F. The use temperatures of TiAl is in the 1700°-1800° F range. Ti-6Al-4V a is titanium base alloy containing 6 weight percent aluminum, 4 weight percent vanadium and the balance is titanium.

As used herein, the term "sub-compact" means a plasma spray as-deposited structure having overall thickness dimensions greater than that of a foil. It may contain or include filament or other reinforcement as a composite or it may include only plasma spray deposited metal. The asdeposited metal of a sub-compact has internal voids and a density below 100%. The compact prepared pursuant to the present invention has a high density closed porosity outer surface layer extending essentially over the complete outer surface of the sub-compact.

BRIEF STATEMENT OF THE INVENTION

It is, accordingly, one object of the present invention to provide a novel fabrication technique by which compacts of as-deposited titanium alloys may be formed with integral HIPing enclosures.

Another object is to provide a method for forming a titanium metal coated compact adapted for ready consolidation.

Another object is to provide a titanium metal covered compact having highly desirable physical properties.

Another object is to provide a method suitable for use in formation of titanium alloy base laminates with silicon carbide or similar reinforcing fibers.

Another object is to provide a method of forming a titanium base metal compact which can be consolidated to a titanium base metal article having properties at least equivalent to those of the corresponding wrought alloy.

Other objects will be in part apparent and in part pointed out in the description which follows.

In one of its broader aspects, objects of the invention may be achieved by

- providing a powder for a metal of an average particle size larger than 100 μm,
- radio frequency plasma spray depositing said powder onto a substrate to form a low porosity plasma deposited layer of said titanium base alloy,
- disposing at least partially plasma deposited structure on the inner portions of said layer,
- radio frequency plasma spray depositing said powder onto said structure and onto the exposed edges of said plasma deposited foil to form a sealed envelope of plasma deposited metal about said structure, and
- hot isostatic pressing said envelope to compress the contents thereof to high density.

As used herein, the term "structure" cannotes a body which contains at least some low pressure plasma deposited material and which may contain other material such as preformed reinforcing material which may be in filamentary form.

BRIEF DESCRIPTION OF THE DRAWINGS

The description of the invention which follows will be understood more clearly if in reading the following specification reference is made to the accompanying drawings in which.

DETAILED DESCRIPTION OF THE PRESENT INVENTION

Figure 1:
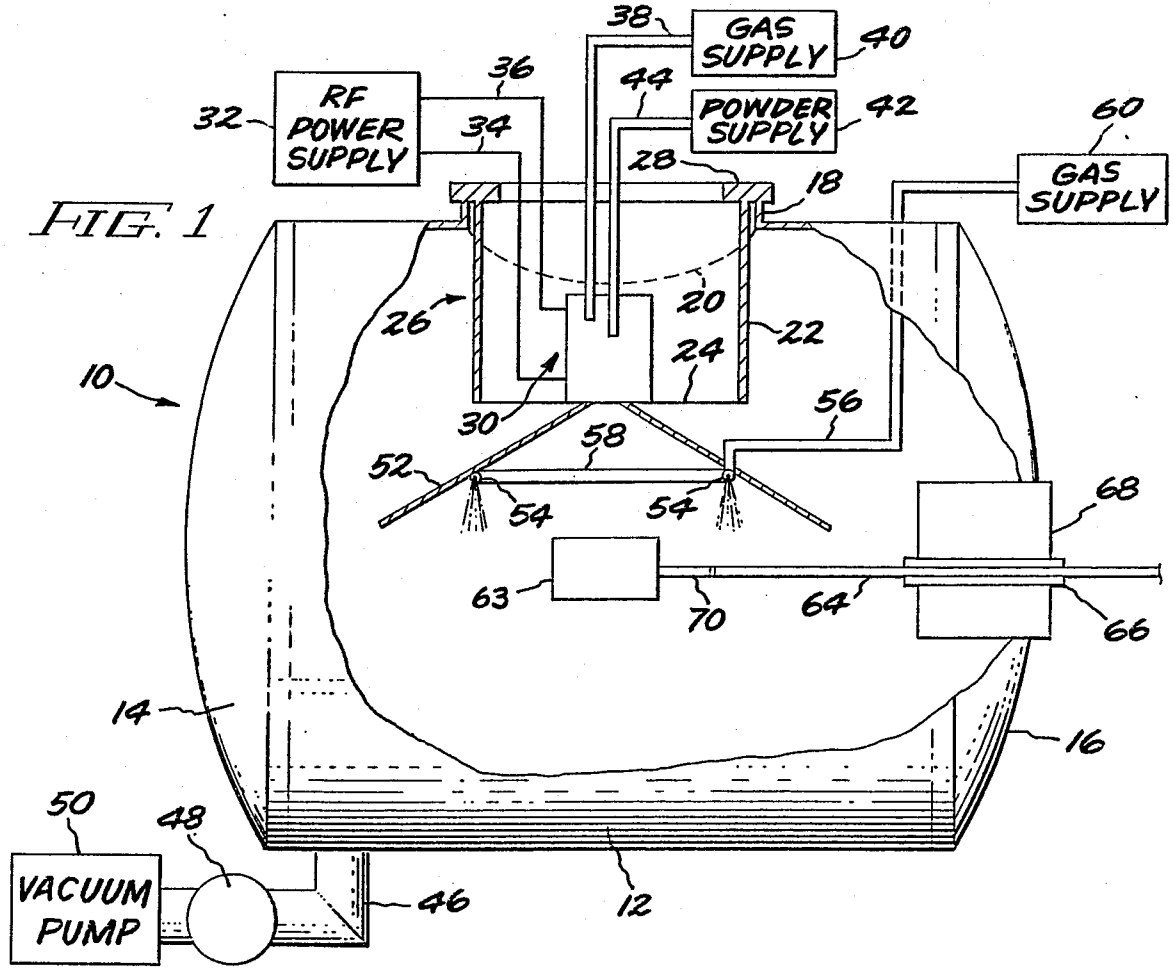
FIG. 1 is a schematic diagram of a system for low pressure RF plasma deposition onto a rotatable platen as a plasma spray receiving surface.

A low pressure radio frequency plasma spray deposit apparatus 10 is made up of a tank 12 having two removable end caps 14 and 16 and the associated apparatus as illustrated in FIG. 1. The tank may have a length of about 5 feet and a diameter of about 5 feet.

At the top of the tank 12 provision is made for introduction of an RF plasma gun into the top of the tank through an opening formed by cutting an opening and welding a collar 18 to the top of tank 12 along seam 20. The RF gun introduced into the tank is positioned within a container in the form of an inverted hat. The hat has sidewalls 22 and bottom wall 24 and has a rim 28 which seats on the collar 18 to provide a hermetic seal by techniques well known in the art.

The gun itself 30 is described in greater detail with reference to FIG. 2. The gun is mounted to the bottom wall 24 of the inverted hat container 26 and is supplied by power and by gas and powder entrained in a carrier gas.

An RF power supply 32 delivers power to the gun 30 over lines 34 and 36. Greater details of its operation are given below with reference to FIG. 2.

Gas is supplied to the interior of gun 30 from gas source 40 through supply means 38. Gas supply means 38 is representative of the means for supply of hydrogen gas or helium gas or argon gas or any mixture of gases as may be needed by the commercially available RF plasma gun such as TAFA Model 66 used in connection with the examples below. The specific gases employed depend on the material being plasma sprayed and the specific gases to be used are known in the art.

Also, powder entrained in a carrier gas, is supplied to the plasma gun from a powder supply means 42 through piping 44.

A low pressure of 200 to 400 torr is maintained within the tank 12 by means of a pump 50 operating through valve 48 and line 46 connected to the tank 12.

A problem of arc striking against wall interiors from the plasma was studied and was overcome by incorporation of a conical shield 52 extending down from gun 30 and by use of gas jets 54 disposed around the plasma flame from gun 30. Gas is supplied to the jets through the pipe 56 from exterior gas supply means 60. The jets are formed by gas flowing through openings drilled through an annular pipe mounted beneath conical shield 52. The pipe 58 shown in phantom serves as a manifold for the gas as well as providing the bottom drilled openings from which the gas jets 54 emerge.

The object illustrated as that to be coated by plasma spray deposit is a platen 63 held by attachment bolt 70 at the end of an arm 64 extending through one end cap 16 of the tank 12. The arm 64 is hermetically sealed through the end cap 16 by a bushing 66 which is mounted within the box 68. Conventional means are provided in the box 68 for vertical positioning of the bushing 66 before the apparatus is evacuated. The rod may be raised or lowered to permit the position of platen 63 or other sample attached at the end of rod 64 to be adjusted to appropriate positions for the coating process to be performed prior to evacuation of tank 12.

While the plasma spray deposition is in progress, sliding lateral positioning of the platen by inward and outward movement of rod 64 through bushing 66 is also feasible. The platen is subject to rotation by imparting a rotary motion to the external portion of rod 64 by conventional means.

Figure 2:
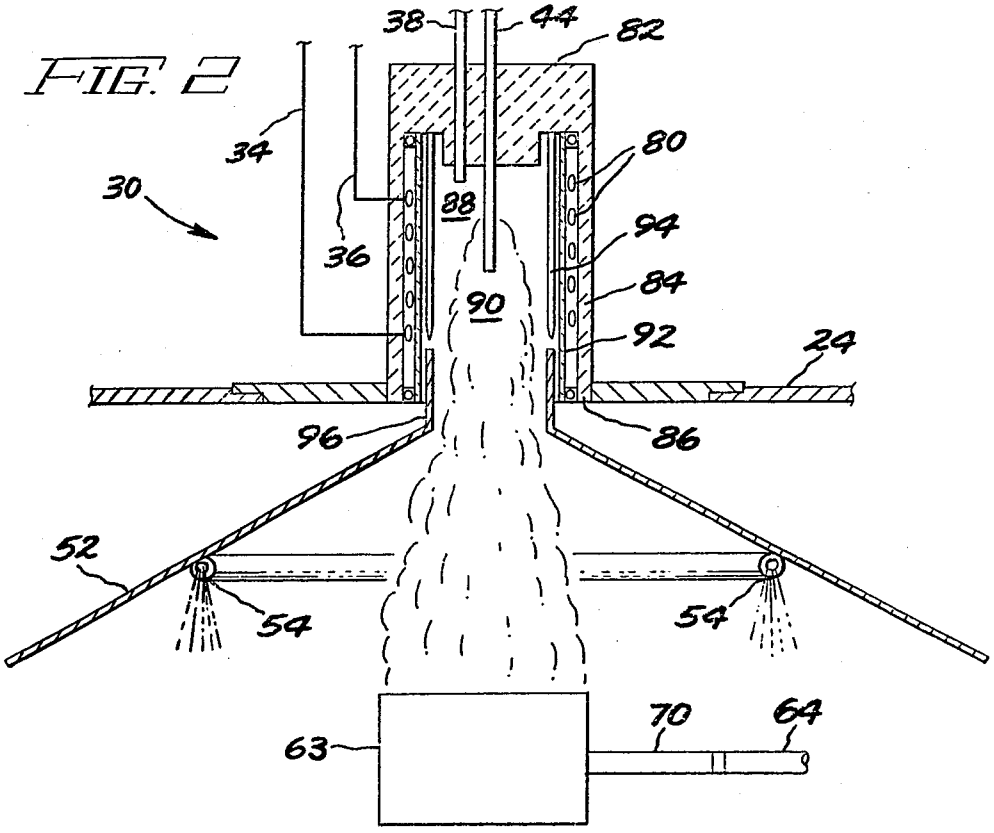
FIG. 2 is a schematic illustration of some details of a low pressure RF plasma gun and deposition apparatus.

Turning now to FIG. 2, a more detailed description of the plasma gun and its operation is provided.

The elements shown in both FIGS. 1 and 2 which bear the same reference numerals are the same articles. It is evident from FIG. 2 that the gun 30 has RF electric supply means 34 and 36 which are the same as those illustrated in FIG. 1. These means are known in the art to be hollow tubes which carry the RF energy and which also carry water to and from the gun for water cooling. Water cooling is necessary because of the high temperatures of 10,000° to 12,000° K generated within the gun.

Also the gas supply means 38 and powder supply means 44 are provided in supply relationship to the elements of gun 30 as they were in FIG. 1.

The gun 30 is provided with a housing, which includes a closed top wall 82, side walls 84 and a lower opening 86 from which the plasma flame extends.

Powder supply means 44 is a triple wall tube having a hollow innermost center tube for supply of powder and carrier gas. The triple wall is made up of a set of three concentric tubes having a cooling liquid, such as water, flowing in cooling relation in the inner and outer passages between the concentric tubes of powder supply pipe 44.

The gas is injected from means 38 into the top of the chamber 88 within gun 30 and above the zone in chamber 88 where the plasma is formed. The plasma itself is generated by having the radio frequency power impressed on the gas within the chamber 88. A suitable frequency range is from 2 to 5 megahertz and the lower end of this range is preferred.

The RF power is delivered through the lines 34 and 36 to a helical coil built concentric to the sidewalls 84 of the gun 30, individual strands 80 of which are evident in section in FIG. 2. The RF coil made up of strands 80 is separated from the chamber 88 and plasma 90 by a quartz tube 92 mounted as a liner within the gun 30. A water cooled copper liner 94 has been found to assist the operation of the gun at higher powers.

The space between gun walls 84 and quartz tube is flooded with water (the coils are in water), so one side of the quartz is directly water cooled.

An exit baffle 96 assists in orienting the flame of the plasma gun 30. The plasma 90 extends from the bottom of the gun downward into heat delivering relation to the platen 63 mounted at the end of rod 64 by a bolt 70.

As explained above, the combination of the stainless steel shield 52 and the gas jets 54 have been successful in preventing an arcing or striking back from the plasma to the walls of the container of the low pressure plasma deposition apparatus 10 as illustrated in FIG. 1.

In operation, a gas or combination of gases is passed through supply means 38 into chamber 88 and the pressure of this gas is kept at a low value of about 250 torr by the action of vacuum pump 50 operating through valve 48 and pipe 46 on the low pressure plasma deposition apparatus including tank 12. The tank itself has a length of about five feet and also a diameter of about five feet. Radio frequency power is impressed on the strands 80 of the coil to excite the gas passing into the housing through tube 38. A plasma 90 is generated within the housing of gun 30. The plasma extends out from the housing and heats the surface of rotating platen 63. The temperature of the plasma is about 10,000° to 12,000° K.

Powder particles, entrained in a carrier gas, are introduced into the plasma through tube 44. The heat of the plasma 90 is sufficiently high to cause a fusion of the particles as they move through the plasma and are then deposited as liquid droplets onto the surface of the platen 63. I have found that the plasma from the RF gun as described above will fuse particles of relatively large diameter of more than 100 μm and will cause them to deposit on a receiving surface from essentially a liquid state.

The vacuum system is operated to maintain a pressure of approximately 250 torr in the low pressure plasma deposition chamber within the container 12. The platen 63 may be rotated within the evacuated chamber as the plasma is used to melt particles into molten droplets to be deposited on the surfaces thereof. Preferably the platen is held stationary and is positioned at right angles to the stream of particles passing through the plasma.

The powder feed mechanism 42 is a conventional commercially available device. One particular model used in the practice of this invention was a powder feeder manufactured by Plasmadyne, Inc. of California. It is equipped with a canister on top that holds the powder. A wheel at the bottom of the canister rotates to feed powder into a powder feed hose 44. The powder is then carried by the carrier gas from the powder feeder along the hose 44 to the chamber 88 of gun 30.

A typical run might be carried out under the following conditions:

| | |
|---|---|
| A power input of 60 Kilowatts | |
| A tank pressure of 250 torr | |
| Gas flow rates for a TAFA Model 66 Gun: | |
| Radial, helium | 117 liters/min. |
| Swirl, hydrogen | 5 liters/min. |
| Swirl, argon | 16 liters/min. |
| cold jet argon | 106 liters/min. |
| Particle Injection: | |
| Carrier, argon | 5 liters/min. |
| Powder, Ti base alloy | 210–250 μm |
| Injection point above nozzle | 7.45 cm. |
| Deposition Data: | |
| Distance Target Nozzle | 11.5" |
| Preheating Time | 10 min. |
| Deposition Time | 10 min. |
| Deposition Rate | 30 grams/min. |
| Mass Deposition efficiency | 90–95% |

Figure 3:
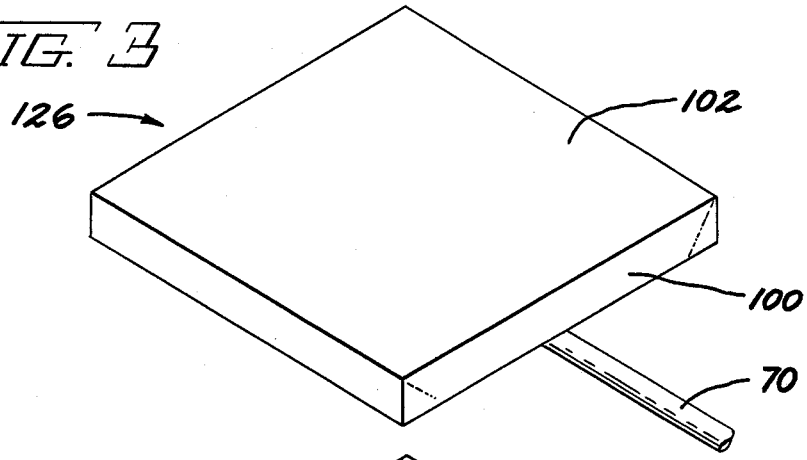
FIG. 3 is a schematic rendering of a planar substrate slab bearing a preformed foil onto which a low porosity plasma spray deposit of a titanium base alloy has been made.

Referring next to FIG. 3, a platen 126, corresponding generally to platen 63 of FIGS. 1 and 2, which serves as a substrate in a low pressure plasma deposition apparatus is illustrated in perspective view.

The platen 126 is supported in the manner illustrated at 63 in FIG. 1 in a position to receive plasma spray deposited titanium metal in a low pressure plasma deposition apparatus as also illustrated in that Figure Platen 126 is covered with a preformed foil 100 which is mounted over and around the platen and the ends and edges of which are folded under the back of the platen.

A layer 102 of dense, low porosity titanium base metal is deposited by low pressure RF plasma deposition as explained above on the face of the preformed foil 100 and forms a substrate for further deposits on the layer covered platen 126.

Figure 4:
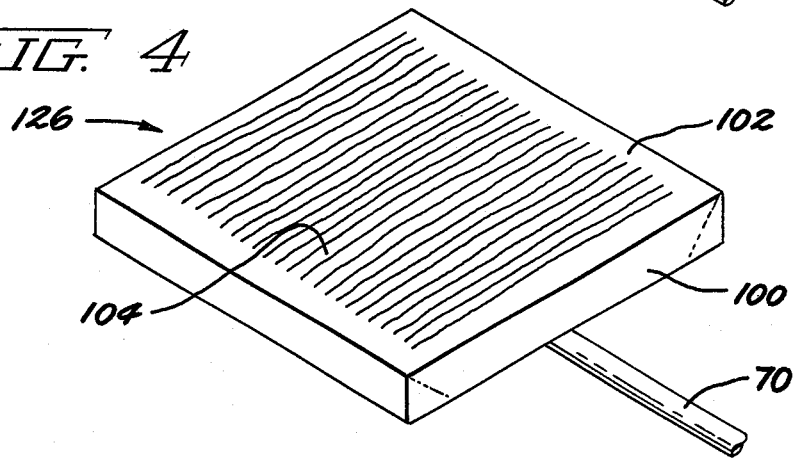
FIG. 4 is a schematic rendering similar to that of FIG. 3 but illustrating an array of high strength high temperature fibers mounted over the central portion of the deposit illustrated in FIG. 3.

Referring next to FIG. 4, a web 104 of closely spaced high strength fibers such as silicon carbide fibers is placed on the plasma formed layer 102 on platen 126. The closely spaced web 104 of fibers may be preformed and may be placed as a preformed unit on the surface of the plasma deposited titanium layer 102. In fact, such webs may be closely spaced at about 100 strands per inch and may be tacked to titanium metal ribbons extending transversely to the fiber strands so that the web may be handled and transferred to a surface such as 102 of FIG. 4.

One such filament has been obtained from Avco Company and is known under the trade designation SCS-6. It is this filament which was used in the studies leading to this invention.

The filaments as described above may be prepared at least in part in accordance with the teachings of one or more of the following patents assigned to Avco Cop. U.S. Pat. Nos. 4,068,637; 4,127,659; 4,481,257; 4,315,968; 4,340,636 and 4,415,609.

A radio frequency plasma gun is commercially available and may be obtained, for example, from TAFA Corp. of California, U.S.A. A TAFA Model 66 may be employed, for example.

I have found that the RF plasma spray deposition of a layer from the larger size particles of average size of over 100 μm results in production of a layer which is sufficiently impermeable to the fluid medium used in hot isostatic pressing that the RF plasma deposited layer can and does serve in place of the conventional sealed can enclosure which is conventionally used in hot isostatic pressing. This is an unusual and unexpected result, for plasma deposited titanium base alloys, inasmuch as it is well known that essentially all as-sprayed plasma spray deposits have limited density and that their density can and is improved by conventional consolidation procedures as for example by vacuum heat treatment or by hot isostatic pressing within a conventional sealed container or can. It was therefore unique and unusual to find that an as-sprayed plasma spray deposit of titanium base metal prepared by a RF plasma spray deposit of larger size particles of titanium could be densified by hot isostatic pressing without the need for sealing and enclosing the deposit within a separate sealed container before introducing the sample into the high pressure high temperature medium in which the hot isostatic pressing (or HIPing) is carried out.

I have found that the composite of plasma formed titanium metal layers enclosing the reinforcing web can be hot isostatically pressed to compact the structure and render it fully dense.

Further, I have found that such hot isotactic pressing of a plasma deposited sample with an integral plasma formed outer layers which effectively form a seal can be hot isotactically pressed using a gaseous pressing medium such as argon and that the product of this HIPing has a highly desirable increase in density as a result of the HIPing.

Alternatively, the composite can be employed as a substrate for the mounting of an additional web or webs of high strength high temperature fibers and the plasma deposit of an additional layer or layers of titanium base alloy to build up the composite structure into a multilayer structure of alternate layers of fibers and metal layers.

Figure 5:
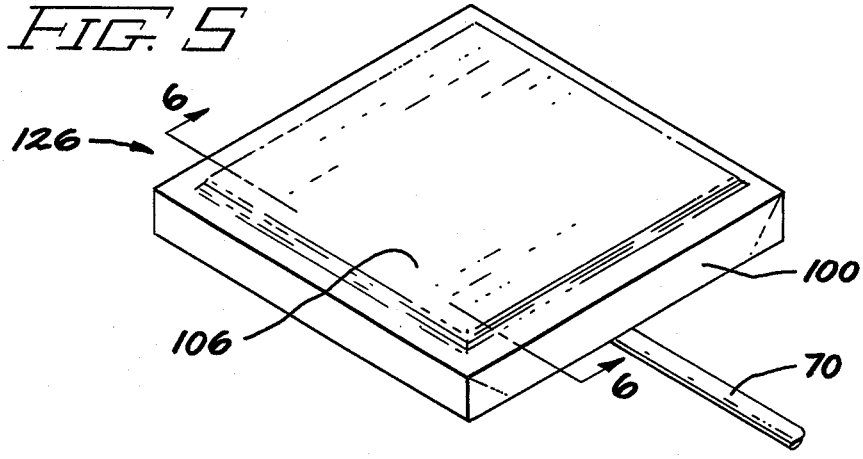
FIG. 5 is a schematic rendering similar to that of FIG. 4 but illustrating the result of plasma spray depositing a titanium base alloy into and onto the array of high strength high temperature fibers mounted according to FIG. 4 to form a structure to be consolidated.

Referring next to FIG. 5, a pre-compaction sealed composite structure is illustrated which is made up of at least two outer plasma deposited layers and which has between the layers at least one web of high temperature high strength reinforcing fibers. Top layer 106 is visible in the Figure. The fibers are at least partially enveloped by the plasma spray deposited titanium base alloy.

Figure 6:
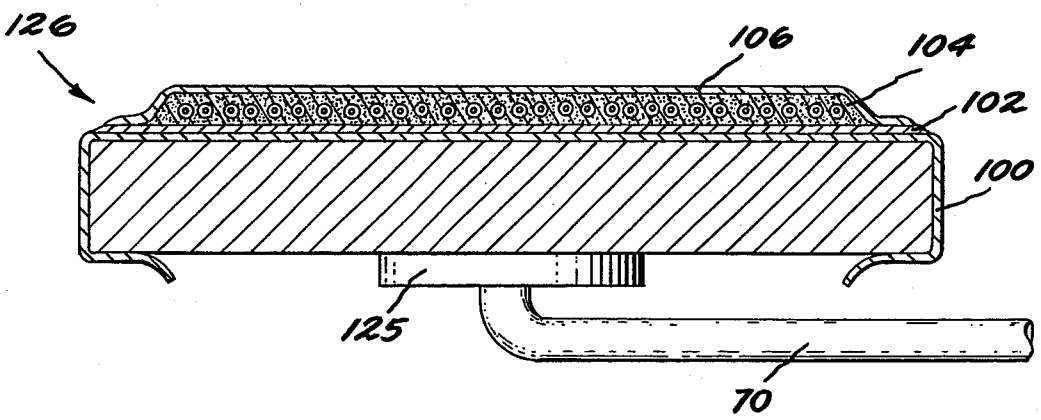
FIG. 6 is a schematic sectional view of a composite structure as prepared pursuant to the present invention taken along the line 6—6 of FIG. 5.

The enveloping of the fibers in the plasma-deposited titanium base alloy is more evident from the illustration of FIG. 6. FIG. 6 is a cross-sectional view of the structure of FIG. 5 but taken along line 6—6 of FIG. 5.

Referring next to FIG. 6, platen 126 is schematically illustrated as supported by flange 125 and flange 125 is mounted in turn to platen 126. Flange 125 is supported by support rod 70 attached in turn to rod 64 in the low pressure plasma deposition apparatus not illustrated in FIG. 6.

Platen 126 has a pre-formed foil 100 of any conventional mandrel material, such as mild steel, mounted about and folded under and against the back of the platen. A first plasma deposited titanium base alloy layer 102 is shown as formed and deposited on the preformed foil 100. Overlaying the titanium alloy layer 102 is a layer 104 of high temperature high strength fibers enmeshed in plasma deposited titanium alloy.

The layer 104 is enclosed within a plasma deposited overlaying foil layer of titanium base alloy 106. Layers 102 and 106 are illustrated in the FIG. as separated foil layers for the sake of clarity of illustration. However, these layers may blend with the metal laden fiber containing layer 104 so that no clear demarcation of layers as shown exists in an actual product.

EXAMPLE 1

Rene 80 powder having a size distribution of −140 +325 mesh about 44 to 105 μm was RF plasma spray deposited in an apparatus as described above onto a steel platen such as 63, using a background pressure of 140 torr. The as-deposited density was about 99.5% of theoretical. The deposit was heat treated in vacuum for 1 hour at 1250° C, and surprisingly, was found to have a heat treated density of 99.3%, a decrease in density. Prior experience with Rene 80 deposits fabricated by low pressure d.c. plasma spraying of −400 mesh powder at 60 torr pressure revealed that an as-sprayed density of 99.5% would increase to 100% with a vacuum heat treatment for 1 hour at 1250° C. This example suggests that contrary to d.c. spray deposits, RF spray deposits do not readily densify to 100% density using a simple heat treatment.

EXAMPLE 2

A 1.5 inch and several inch long diameter tube attached for rotation by a bolt 70 to rod 64 was used in place of the platen 126 in the figures. The tube was used in order to permit collection of a heavy sample of the plasma spray deposited material having both a densely deposited inner surface and a densely deposited outer surface. The heavy deposit of about ¼ inch thickness was sought so that the deposited material could be consolidated and so that the consolidated material could be tested for properties.

A heavy plasma spray deposit of titanium base alloy, Ti-6Al-4V, was formed on the tube amounting to about one quarter of an inch. The thicker deposit was made so that tests of the tensile and elongation (ductility) properties of a plasma spray deposit could be made and compared to standard reference book values of a wrought alloy of the same composition.

The sample deposit on the tube was hot isostatically pressed at 1000° C following deposition of the deposit. The sample was not enclosed in a sealed can during the hot isostatic pressing because the outer surface of the asdeposited sample was found to have closed porosity in the as-deposited condition.

Figure 7:
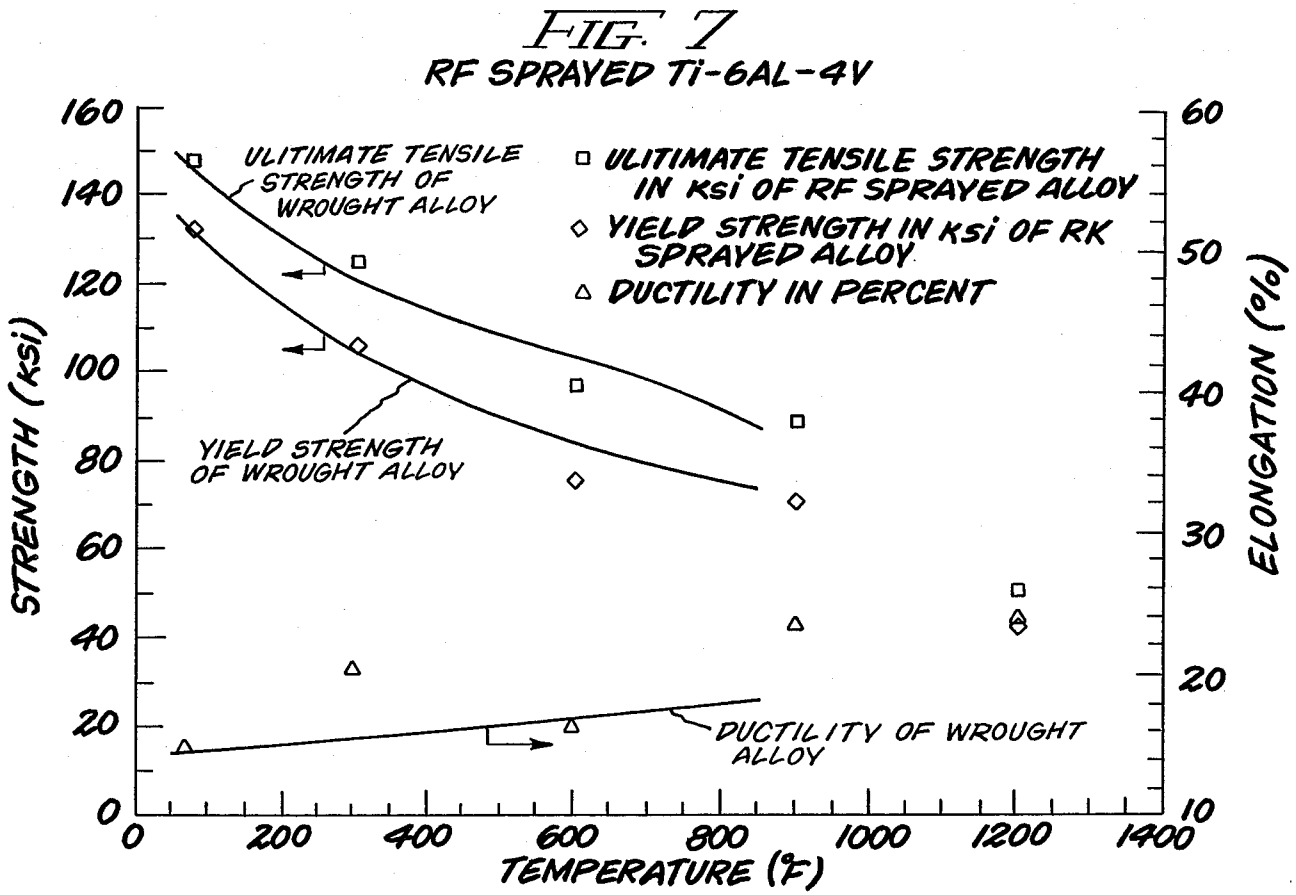
FIG. 7 is a graph in which tensile and elongation properties are plotted against temperature for an RF plasma sprayed and consolidated sample of a titanium base alloy.

The results of the tests are plotted in FIG. 7. With reference to this figure, the standard reference book values of ultimate tensile strength, yield strength and ductility for the wrought alloy are shown by the solid lined plots of FIG. 5 for a temperature range of room temperature up to about 850° F.

The values of the ultimate tensile strength and ductility for the plasma spray deposited alloy Ti-6Al-4V are plotted according to the legends on the FIG. 7 for room temperature; 300° F; 600° F; 900° F and 1200° F.

As is evident from the data in the plot of FIG. 5, the properties of the HIPed sample of the RF plasma spray deposited titanium base alloy were at least fully equivalent to those of a wrought sample prepared by conventional wrought processing. Based on these data, the properties of HIPed Ti-alloy prepared by the RF plasma spray deposit process were deemed to be essentially equivalent to those of wrought material prepared by conventional casting and rolling processing.

As is evident from the above example, the present invention is very valuable in consolidating a plasma deposited structure of generally homogeneous cross section. However, the present invention is deemed to be particularly useful and valuable when used in connection with the enveloping of structures which have some degree of porosity. Such porosity commonly occurs in structures which have reinforcing elements incorporated therein. Such a structure is exemplified by that described above relative to FIGS. 3 through 6.

In addition, composites having low porosity metal surfaces can be formed to contain ceramic materials also deposited by low pressure plasma spray operations. For example, a matrix of ceramic and metal may be deposited by low pressure plasma deposition.

Thus, a composite of a matrix metal and aluminum oxide which is plasma spray deposited in alternate layers of metal and oxide will have lower density as the percentage of oxide increases and particularly when it increases above 50 volume percent. However, if such a metal-ceramic matrix is formed within a RF plasma deposited low porosity metal envelope, the structure may be effectively HIPed without resort to the use of a separate HIPing enclosure or can.

Very valuable structures are prepared in this way.

What is claimed is:

1. The method of forming a relatively high density structure including an enclosing envelope of low pressure plasma deposited titanium base metal which comprises RF plasma spray depositing at low pressure a first low porosity outer layer of said metal as a first element of said envelope, superposing on said first outer layer a sub-compact to be consolidated to high density, low pressure RF plasma spray depositing a second low porosity outer layer of said metal as a second element of said envelope over said sub-compact to form a compact which includes a sealed envelope of titanium based metal plasma deposited about said sub-compact, and consolidating the compact so formed at high pressure and high temperature to a relatively high density structure by direct application of fluid pressure to said envelope.

2. The process of claim 1 in which the sub-compact is a titanium base metal.

3. The process of claim I in which the metal is titanium 6Al-4V alloy.

4. The process of claim 1 in which the metal is titanium 6Al-2Sn-4Zr-2Mo alloy.

5. The process of claim 1 in which the metal is Ti-14Al-21Nb.

6. The method of forming a relatively high density structure including an enclosed envelope of low pressure plasma deposited titanium base metal which comprises providing as a first element of said envelope a non-porous substrate surface onto which a plasma spray deposit can be made, superposing on said non-porous substrate a sub-compact to be consolidated to high density, low pressure RF plasma spray depositing a low porosity outer layer of metal as a second element of said envelope over said sub-compact to enclose said sub-compact in a envelope formed of said non-porous surface and said low porosity outer layer, and consolidating the compact so formed at high pressure and high temperature to form a relatively high density structure by direct application of fluid pressure to said envelope.

7. The method of claim 6 in which the sub-compact is a titanium base metal.

8. The method of claim 6 in which the metal is a titanium 6Al-4V alloy.

9. The method of claim 6 in which the metal is a titanium 6Al-2Sn-4Zr-2Mo alloy.

10. The method of claim 6 in which the metal is Ti-14Al-21Nb.

* * * * *